United States Patent [19]

Aulgur et al.

[11] Patent Number: 4,915,106

[45] Date of Patent: Apr. 10, 1990

[54] CREW OXYGEN MASK WITH PNEUMATIC COMFORT ADJUSTMENT

[75] Inventors: Charles C. Aulgur, Raytown, Mo.; David A. DiPasquale, Overland Park, Kans.; Thomas K. McDonald, Lees Summit; Alan E. Kidd, Kansas City, both of Mo.

[73] Assignee: Puritan-Bennett Corporation, Lenexa, Kans.

[21] Appl. No.: 160,658

[22] Filed: Feb. 26, 1988

[51] Int. Cl.[4] ..... A62B 18/08

[52] U.S. Cl. ..... 128/207.11; 128/205.24

[58] Field of Search ..... 128/205.11, 207.11, 128/205.24

[56] References Cited

U.S. PATENT DOCUMENTS

| | | | |
|---|---|---|---|
| 2,378,468 | 6/1945 | Deming | 128/205.11 |
| 3,599,636 | 8/1971 | Gutman et al. | 128/146.7 |
| 3,608,574 | 9/1971 | Beaussant | 137/102 |
| 4,172,455 | 10/1979 | Beaussant | 128/142.7 |
| 4,230,097 | 10/1980 | Beaussant | 128/1 A |
| 4,437,462 | 3/1984 | Piljay et al. | 128/207 |
| 4,546,491 | 10/1985 | Beaussant | 2/2.1 A |
| 4,577,375 | 3/1986 | Beaussant | 128/205.24 |
| 4,616,646 | 10/1986 | Beaussant | 128/205.24 |
| 4,664,108 | 5/1987 | Ansite | 128/202.26 |

FOREIGN PATENT DOCUMENTS 2145767 1/1985 United Kingdom .

*Primary Examiner*—Edgar S. Burr
*Assistant Examiner*—Aaron J. Lewis
*Attorney, Agent, or Firm*—Hovey, Williams, Timmons & Collins

[57] ABSTRACT

A respirator especially constructed for flight crews has a harness strap which can be inflated to a somewhat rigid, self-sustaining orientation to permit one-handed placement of the respirator over the wearer's head. Once the respirator is in place, release of a lever for inflating the strap deflates the latter to an orientation sufficient to cause the resilient strap to tightly press a peripheral seal of the respirator mask against nose and mouth areas of the user's face. A comfort adjustment to relieve strap tension permits selective reinflation of the strap to a somewhat smaller value than necessary for initial donning of the harness, and the limited reinflation pressure is sufficient for causing the mask to seal against the face during pressure demand breathing. In instances where pressurized breathing is needed, however, pressure within the strap is automatically released so that the strap presents sufficient bias to hold the mask against the face without oxygen leakage therepast.

9 Claims, 2 Drawing Sheets

CREW OXYGEN MASK WITH PNEUMATIC COMFORT ADJUSTMENT

BACKGROUND OF THE INVENTION

1. Field of the Invention

This invention broadly relates to a flight crew oxygen mask having an extensible harness which is inflatable to enable the mask to be quickly donned, and then deflatable to permit the inherent resiliency of the harness to tightly urge the mask against the user's face over the nose and mouth area. More particularly, the invention concerns a valving arrangement for permitting limited reinflation of the harness when worn during certain flight conditions to increase the comfort of the wearer and relieve a portion of the tension of the harness holding the mask against the face.

2. Description of the Prior Art

An inflatable head harness for respirator devices is described and illustrated in U.S. Pat. No. 3,599,636 and comprises a mask that is connected to an elongated, extensible harness or strap having internal conduits connected by a valve to a source of pressurized air. When the valve is opened, air admitted to the conduits of the strap cause the strap to stretch and assume a somewhat rigid configuration. In this manner, the user can grasp the mask with one hand and direct the inflated strap behind his or her head, a particularly useful feature in an emergency situation for a flight crew when only one free hand is available.

Once the harness of the respirator shown in U.S. Pat. No. 3,599,636 is placed over the head, the strap is deflated and contracts in length. Thereafter, the inherent resiliency of the deflated strap urges the mask in tight engagement with the nose and mouth areas of the wearer's face in an attempt to avoid peripheral leakage of the breathable gas.

As a rule, flight crew masks must be pressurized when the aircraft is flying at cabin altitudes above approximately 40,000 feet in order to force air into the user's lungs. At these altitudes, therefore, the straps must exert a relatively large biasing force pressing the mask against the face to overcome the pressure of the oxygen urging the mask away from the skin and prevent oxygen leakage around the peripheral seal of the mask. However, at cabin altitudes of less than 40,000 feet, pressurized breathing conditions within the chamber of the mask are unnecessary and the regulator operates upon demand breathing such that an oxygen enriched air mixture is admitted to the mask only as the user inhales.

In general, the substantial majority of flight time is incurred at cabin altitudes at less than 40,000 feet. There are many situations, however, where the respirator mask must be worn at all times such as in cases where only one crew member is present. Therefore, the harness straps represent a substantial source of discomfort at lower altitudes when the respirator must be worn on the head at all times since the straps normally present a large degree of force even though pressurized breathing conditions are unnecessary.

The design and construction of flight crew respirators is subject to safety considerations as well as governmental regulations. In this regard, the respirator should be capable of being donned within few seconds in emergency situations with only one hand so that the remaining hand is free to operate the aircraft controls. As such, devices for relieving or increasing strap tension which require the use of two hands are completely unacceptable.

SUMMARY OF THE INVENTION

Our present invention concerns a comfort control system for a flight crew respirator having an inflatable harness strap. The comfort control system, in brief, comprises a valving arrangement which reinflates the strap to a limited extent to thereby extend the strap length and relieve a portion of the tension which would otherwise tightly urge the mask against the crew member's face.

In more detail, the respirator of our present invention has a single control lever which, when depressed, inflates the harness strap to a fully stretched, relatively rigid orientation for one-handed manuevering of the strap behind the wearer's head. Manual release of the control lever shifts a valve for immediate deflation of the strap, and the length and resiliency of the strap are such that the mask is urged tightly against the wearer's face as may be necessary for inhalation under pressurized mask conditions. In the event pressurized breathing is not needed, however, a slight nudging of the control lever causes the harness strap to be partially reinflated to a limited pressure which is sufficient for extending the strap to a length that relieves a substantial portion of the strap tension without enabling the mask to disengage the face and allow leakage during demand breathing conditions.

In one preferred embodiment of the invention, the respirator is provided with an aneroid valve assembly which includes a bellows-like device responsive to cabin pressure. In instances where the cabin pressure is lowered, the bellows expand to open a relief valve and vent the harness strap to atmosphere, thereby causing the resiliency of the deflated strap to urge the mask tightly against the wearer's face. In this manner, the straps are promptly and automatically returned to an orientation suitable for enabling the crew member to breath pressurized oxygen without leakage of the same around the peripheral seal of the mask.

In other preferred forms of the invention, the comfort control system includes a valve member which is longitudinally shiftable to three positions corresponding to initial strap inflation, strap deflation, and partial reinflation of the strap for comfort. The lever may be nudged or "bumped" any number of times to increase, in stepwise fashion, the pressure in the strap during reinflation so that a suitable strap pressure for a desired comfort level can be precisely selected. However, the reinflated strap is automatically deflated by the valve if the wearer admits an excessive quantity of oxygen into the strap, which might otherwise prevent the peripheral edge of the mask from sealing against the user's face during non-pressurized breathing conditions.

DETAILED DESCRIPTION OF THE DRAWINGS

Figure 1:
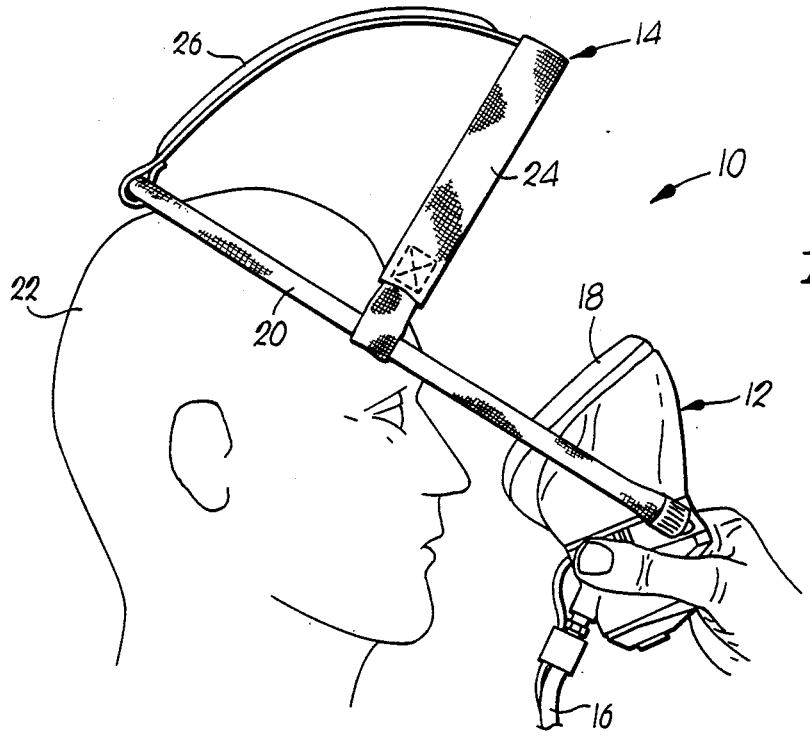
FIG. 1 is a fragmentary, side elevational view of the respirator of the present invention with a harness strap of the respirator shown in an inflated condition to permit one-handed placement of the harness over the user's head.
Figure 2:
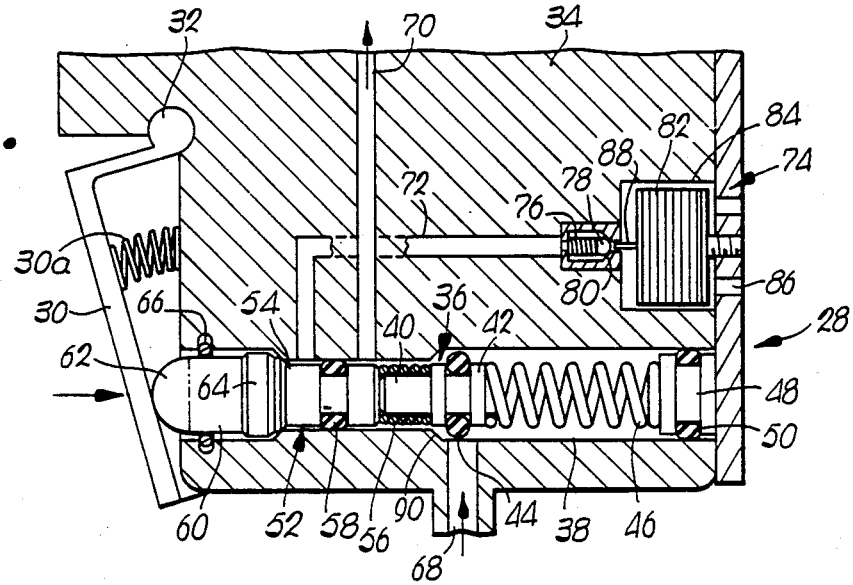
FIG. 2 is a fragmentary, enlarged, cross-sectional view illustrating a valve assembly and comfort control system of the respirator shown in FIG. 1 as a lever of the valve assembly is depressed to inflate the strap.

Referring initially to FIGS. 1 and 2, a respirator 10 constructed in accordance with the principles of the present invention includes a mask assembly 12 that is connected to a harness assembly 14. A section of flexible tubing 16 interconnects the mask assembly 12 with a source of pressurized gas such as oxygen. The mask assembly 12 includes an internal regulator 13 which mixes the incoming, pressurized gas with atmospheric air for delivery of a breathable gas mixture to a chamber within the mask assembly that is bounded by a resilient, peripheral seal 18. In the preferred embodiment, mask assembly 12 covers the nose and mouth of the user. Those skilled in the art will appreciate that mask assembly 12 could also be a full face mask as a matter of design choice, for example.

The harness assembly 14 includes an inflatable member or strap 20 connected to opposite sides of the mask assembly 12 in a generally U-shaped configuration for placement behind the head 22 of the user. Opposite sides of the U-shaped strap are connected to a flexible band 24 that normally extends over the wearer's head 22 in the manner shown in FIG. 3. In addition, an elongated, arcuate, somewhat stiff rear band 26 interconnects a rear portion of the strap 20 and a middle region of band 24.

Figure 4:
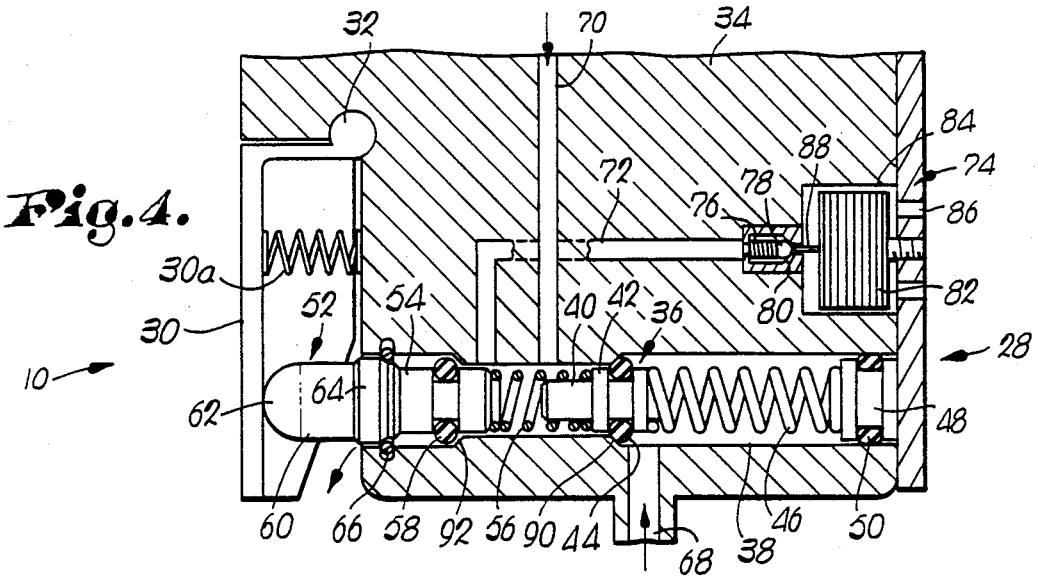
FIG. 4 is a fragmentary, enlarged, side cross-sectional view of the valve assembly and comfort control system illustrated in FIG. 2, showing the valve assembly in an orientation for deflating the strap.
Figure 5:
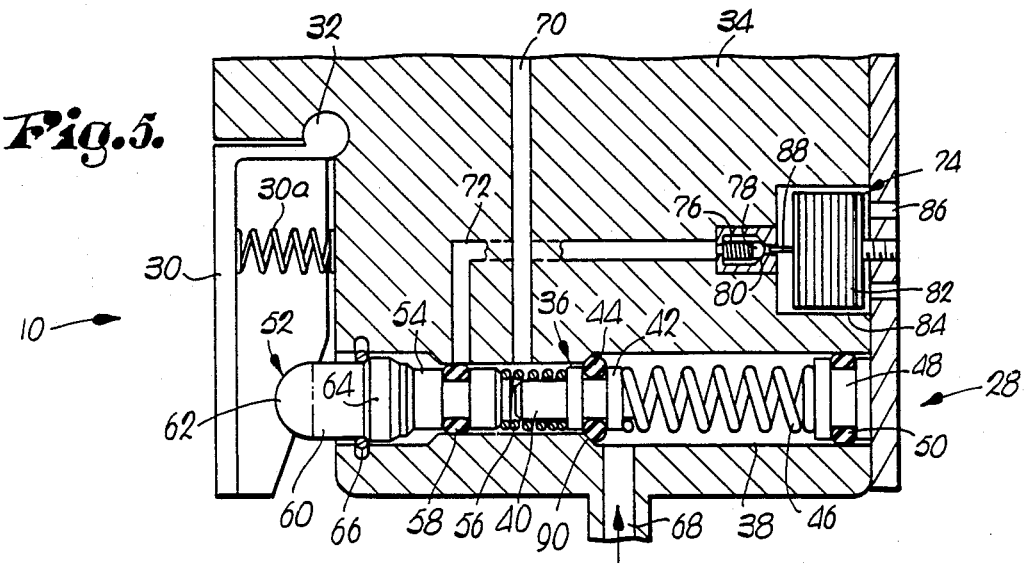
FIG. 5 is a view somewhat similar to FIGS. 2 and 4 except that the lever has been nudged to shift the valve assembly toward an orientation enabling limited reinflation of the harness strap for comfort of the wearer.

A valve assembly and comfort control system 28 of the respirator 10 is shown in more detail in FIGS. 2, 4 and 5 and includes a lever 30 mounted on an external side of the mask assembly 12 for ready access to the wearer's fingers when the mask assembly 12 is grasped in the manner shown in FIG. 1. The lever 30 is formed with a cylindrical portion 32 that is received in a complementally configured portion of a valve body 34 for pivotal movement of the lever 30 in an arc between the position shown in FIG. 2 and the position shown in FIG. 4. Spring 30*a* biases lever 30 outwardly and to the left as viewed in FIGS. 2, 4, and 5.

The valve assembly 28 includes a first plunger or supply plunger 36 disposed in a bore 38 formed in the valve body 34. The supply plunger 36 includes a generally cylindrical shaft section 40 and a pair of spaced-apart, enlarged flanges 42 that present an annular groove therebetween which carries an 0-ring seal 44.

The supply plunger 36 is biased in a direction toward the left when viewing FIGS. 2, 4 and 5 by means of a helical compression spring 46 that is received around one end of the cylindrical shaft section 40. The end of the spring 46 remote from the supply plunger 36 is in contact with a spool-shaped member 48 that carries a resilient, sealing 0-ring 50.

The valve assembly 28 further includes a second plunger or comfort plunger 52 which is also received in the valve body bore 38 between lever 30 and the supply plunger 36. The comfort plunger 52 has a reduced diameter cylindrical section 54, and a spring 56 bears against the cylindrical section 54 of the comfort plunger 52 and the outermost flange 42 of the supply plunger 36 in surrounding relationship to the cylindrical shaft section 40 of the supply plunger 36. The cylindrical section 54 of the plunger 52 is also formed to present an annular groove that captures an 0-ring 58 in sealing contact with adjacent walls of the bore 38 when the comfort plunger 52 is in the positions shown in FIGS. 2 and 5.

The comfort plunger 52 also includes an enlarged diameter cylindrical section 60 that is shaped to present a smoothly rounded, spherical end region 62 engageable with lever 30 when the latter is depressed as shown in FIGS. 2 and 4. In addition, the cylindrical section 60 is formed to present an annular boss portion 64 which is tapered on opposite sides. Moreover, as shown in the drawings, the comfort plunger 52 is tapered in an intermediate region interconnecting the cylindrical section 60 and the reduced diameter cylindrical section 54.

The valve body 34 is constructed with a recess which retains a generally U-shaped spring 66 in the nature of a bail. The valve body 34 further includes an inlet passage 68 that is connected to a source of pressurized gas by means of tubing 16. An outlet passage 70 extends away from bore 38 and communicates with the fluid conduit within the strap 20 of the harness assembly 14.

Finally, valve body 34 is also provided with an internal passage 72 leading from the bore 38 toward an aneroid valve assembly 74. The assembly 74 includes check valve structure comprising a spring 76 positioned to urge a spherical ball 78 against a valve seat 80. The assembly 74 also includes an aneroid or sealed bellows device 82 disposed within a chamber 84 that communicates with the cabin atmosphere by means of ports 86. Also, one side of the bellows device 82 is fixed to a rod 88 which extends toward the center of valve seat 80 and ball 78.

OPERATION

When the respirator 10 is initially grasped by the hands as shown in FIG. 1, the forefinger of the user engages lever 30 to pivot the same around cylindrical portion 32 and depress the comfort plunger 52 in the manner shown in FIG. 2. Depression of the plunger 52 overcomes the relatively slight bias presented by the spring 56 such that the inwardmost end of plunger 56 comes into contact with the outermost end of supply plunger 36. Continued depression of the lever 30 in the direction of the arrow shown in FIG. 2 shifts plunger 36 to the right, thereby unseating the 0-ring 44 from an annular, tapered valve seat 90.

Once the 0-ring 44 is lifted from valve seat 90, pressurized air admitted through inlet passage 68 traves around the seal 44 and along the supply plunger 36 toward the outlet passage 70. As a result, the fluid conduit within the strap 20 is pressurized to a value substantially equal to the pressure in passage 68 in order to inflate strap 20 and cause the latter to stretch in a longitudinal direction, thereby assuming a relatively rigid, self-sustaining orientation which is shown in FIG. 1 for enabling the harness assembly 14 to be readily placed over the wearer's head 22 without the need for gripping and adjusting strap 20.

Preferably, the strap 20 is in the form of an assembly which includes inner silicon tubing presenting the fluid conduit, and an outer covering material that is contructed by interlacing spandex fibers with fibers of a DuPont material available under the tradename NOMEX. The spandex and NOMEX are braided together to form a fabric covering the silicon tubing, and are useful for retaining the cylindrical shape of the tubing inasmuch as the tubing, when pressurized, may form enlarged bubble-type regions or the like. The NOMEX is relatively inextensible, while the spandex is extensible so that the strap 20 has essentially the same appearance whether inflated or deflated. In the prior art, inflatable harness straps often presented a series of convolutions or ripples in the outer surface when deflated which tended to snag or otherwise interfere with walls of the storage compartment when the respirator was not in use.

Once the harness assembly 14 is placed over the wearer's head 22 and the mask assembly 12 shifted toward the nose and mouth area of the wearer, lever 30 is released and oxygen pressure within the passage 70 bears against the 0-ring 58 and the comfort plunger 52 to cause the plungers 36, 52 to shift toward the left viewing FIG. 4. In this regard, springs 46, 56 also facilitate leftward shifting of the comfort plunger 52 when the lever 30 is released, but for the most part the pressure within passage 70 represents the majority of the driving force urging the comfort plunger 52 and supply plunger 36 to the left.

Consequently, once lever 30 is released, 0-ring 44 carried by the supply plunger 36 moves toward a position of sealing contact with the valve seat 90 and prevents additional quantities of pressurized oxygen from reaching passage 70 from passage 68. The strap 20 is thereby vented through passage 70, along the leftward portion of bore 38 (as viewed in FIG. 4) toward lever 30, and around a gap 92 presented between the 0-ring 58 and an adjacent, tapered portion of the valve body 34 in bore 38. The pressurized oxygen within the strap 20 is thus fully vented to the cabin atmosphere, and the inherent resiliency of the silicon tubing and the spandex of the strap 20 thereafter urge the peripheral seal 18 of the mask assembly 12 into tight, firm, sealing contact with nose and mouth regions of the user's head 22.

Figure 3:
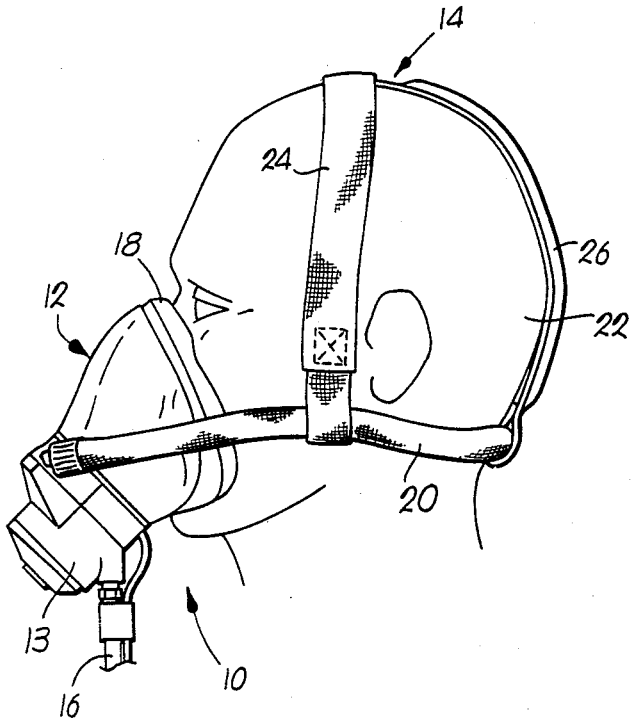
FIG. 3 is a fragmentary elevational view of the respirator shown in FIG. 1 taken on the opposite side of the wearer's head and showing the strap in a deflated condition after release of the lever.

The strap 20 when deflated as shown in FIG. 3 presents sufficient bias to seal the mask assembly 12 against the wearer's head 22 for pressurized breathing as may occur at cabin altitudes of 40,000 feet. In some cases, and especially at altitudes approaching 45,000 feet, the air within the mask assembly 12 must be pressurized to a value approximating 13 inches of water pressure, and consequently it can be realized that strap 20 must be sufficiently stiff to tightly urge the seal 18 against the wearer's face and prevent the pressurized oxygen from escaping. However, at cabin altitudes less than 40,000 feet, pressurized breathing is unnecessary and instead pressure within the mask assembly 12 is substantially eliminated such that oxygen enriched air mixture is drawn into the mask upon demand due to the force presented by the inhalation of the user.

During non-pressure demand breathing, then, it is desirable to reduce the tension exerted by the strap 20 for comfort reasons. To this end, the user simply nudges the lever 30 in a counterclockwise direction as viewed in FIG. 5 to shift the comfort plunger 52 to right until such time as the O-ring 44 is lifted from the valve seat 90. Pressurized oxygen from the inlet passage 68 then travels between the 0-ring 44 and the seat 90 and toward the outlet passage 70 to reinflate the harness strap 20. As soon as the user nudges lever 30 and releases the same, comfort plunger 52 is urged to the left viewing FIG. 5 due to the influence of the pressure within passage 70 as well as the bias presented by springs 46, 56 until such time as the boss portion 64 comes into contact with the bail spring 66. Simultaneously, the 0-ring 44 shifts toward sealing contact with valve seat 90 to prevent further pressurized oxygen from passing from passage 68 to passage 70.

The spring 66, when in contact with boss portion 64, is sufficiently stiff to retain the comfort plunger 52 in the position shown in FIG. 5 for an extended period of time. In this position of the comfort plunger 52, the 0-ring 58 seals against the walls defining the bore 38 to substantially prevent oxygen within passage 70 as well as the partially inflated strap 20 from venting to the atmosphere in areas adjacent the enlarged cylindrical section 60.

In some cases, however, the user may depress the lever 30 for an extended period of time or may bump or nudge the lever 30 a relatively large number of times in separate incidents to thereby increase the pressure within passage 70 and strap 20 to a value exceeding a desired pressure such as 25 PSI. If such excessive pressures occur after lever 30 is released, the pressurized gas, in combination with springs 46, 56, shift the comfort plunger 52 to the left viewing FIG. 5 with a force adequate for spreading the legs bail spring 66 and causing the same to ride over the annular boss portion 64. As a consequence, the valve assembly 28 including comfort plunger 52 shift to the left of the position shown in FIG. 4 such that the pressurized oxygen within passage 70 as well as within strap 20 is instantly vented to atmosphere through the gap 92. The strap 20 thus cannot remain inflated (once lever 30 is released) at pressures which might otherwise prevent adequate contact between seal 18 and the wearer's face.

The aneroid valve assembly 74 represents a means for automatically decreasing the pressure within the strap member 20 whenever certain atmospheric pressure conditions within the cabin are sensed. In particular, if cabin pressure decreases, the sealed bellows device 82 expands and causes rod 88 to engage ball 78, thereby shifting the latter to the left viewing FIGS. 2, 4 and 5, toward a position spaced from seat 80. As a consequence, air pressure within the bore 38 between 0-rings 44, 58 when the valve assembly 28 is in the comfort mode shown in FIG. 5 is quickly vented to the cabin for automatic deflation of the strap 20 without the need for manual intervention.

It should now be realized by those skilled in the art that the present invention represents an especially effective means for providing comfort to the user when pressurized breathing is unnecessary. The comfort plunger 52 comprising a means for selectively permitting limited reinflation of the strap 20 to any one of a number of pressures preferably equal to or less than approximately 25 PSI. In this regard, inlet pressure within passage 68 is desirably on the order of 60 to 85 PSI in order to provide sufficient gas for pressurized breathing and to maintain the strap 20 in its substantially rigid, self-sustaining orientation shown in FIG. 1 when the lever 30 is fully depressed for full inflation of strap 20.

We claim:

1. Safety apparatus for use in an airplane or the like, comprising:

mask means adapted to be fit against the face of a person and including structure presenting, when so fitted, a chamber adjacent the nose and mouth region of said person for the reception of a breathable gas mixture;

means for delivery of said breathable gas mixture to said chamber, including means operably coupled with said mask means for delivery of pressurized oxygen thereto, and regulator means for mixing atmospheric air with said pressurized oxygen to form the gas mixture;

an extensible, inflatable strap element operably connected with said mask means and extendable from a fully deflated position corresponding to a relatively low pressure therewithin which is substantially ambient pressure to a fully inflated position corresponding to full inflation pressure therewithin, and inflation control means operatively interconnecting said oxygen delivery means and said strap element, comprising manually controlled structure for selective inflation of the strap element to said full inflation pressure in order to extend the strap element to said fully inflated position to permit fitting thereof over the head of the person, and for deflation of the element to engage the head of the person to hold the mask in said fitted position, said inflation control means further including inflation level-maintaining means for selectively establishing and maintaining the level of inflation of the strap element at an intermediate gas pressure less than said full inflation pressure and greater than said relatively low pressure, said inflation level-maintaining means having structure for maintaining said intermediate gas pressure within said strap element without manual manipulation of said inflation control means.

2. Apparatus as set forth in claim 1, said inflation level-maintaining means including structure for maintaining the level of inflation of the strap element at any one of a number of intermediate gas pressures less than said full inflation pressure and greater than said relatively low pressure.

3. Apparatus as set forth in claim 1, including aneroid means operatively coupled with said inflation control means for fully deflating said strap element in the event of depressurization of the atmosphere adjacent said mask.

4. Apparatus as set forth in claim 1, said inflation level-maintaining means and said inflation control means including structure for initial deflation of said element to said fully deflated position thereof, and for selective reinflation of the element to said intermediate gas pressure.

5. Apparatus as set forth in claim 4, said reinflation structure comprising a shiftable valve assembly, and spring means releasably contacting a portion of said valve assembly.

6. Apparatus as set forth in claim 1, said mask means including separate structure for covering only the nose and mouth region of the person.

7. Safety apparatus for use in an airplane or the like, comprising:

mask means adapted to be fit against the face of a person and including structure presenting, when so fitted, a chamber adjacent the nose and mouth region of said person for reception of a breathable gas mixture;

means for delivery of said breathable gas mixture to said chamber, including means operably coupled with said mask means for delivery of pressurized oxygen thereto, and regulator means for mixing atmospheric air with said pressurized oxygen to form the gas mixture;

an extensible, inflatable strap element operably connected with said mask means and extendable from a fully deflated position corresponding to a relatively low pressure therewithin which is substantially ambient pressure to a fully inflated position corresponding to full inflation pressure therewithin; and inflation control means operatively interconnecting said oxygen delivery means and said strap element, comprising manually controlled structure for selective inflation of the strap element to said full inflation pressure in order to extend the strap element to said fully inflated position to permit fitting thereof over the head of the person, and for establishing an intermediate gas pressure less than said full inflation pressure and greater than said relatively low pressure in said strap element after the element is fitted over the head of the person, said inflation control means further including fine adjustment structure for selective fine adjustment of the pressure within the strap element after said intermediate gas pressure is established and over a pressure adjustment range substantially less than the pressure difference between said full inflation pressure and said relatively low pressure.

8. Safety apparatus as set forth in claim 7, said fine adjustment structure including override means for preventing elevation of pressure within said strap element above a predetermined maximum pressure during use of the fine adjustment structure.

9. Safety apparatus as set forth in claim 7, said fine adjustment structure including means for raising the pressure within said strap element after said intermediate gas pressure is established.

* * * * *